US010086312B2

(12) United States Patent
de Viveiros Ortiz

(10) Patent No.: US 10,086,312 B2
(45) Date of Patent: Oct. 2, 2018

(54) DISPENSING APPARATUS FOR DISPENSING CONFETTI IN RESPONSE TO AN OCCURRENCE OF AN EVENT ON A GAMING MACHINE

(71) Applicant: International Gaming Project Limited, Qormi (MT)

(72) Inventor: Alejandro de Viveiros Ortiz, Sao Paulo (BR)

(73) Assignee: International Gaming Project Limited, Qormi (MT)

( * ) Notice: Subject to any disclaimer, the term of this patent is extended or adjusted under 35 U.S.C. 154(b) by 0 days.

(21) Appl. No.: 15/131,056

(22) Filed: Apr. 18, 2016

(65) Prior Publication Data

US 2017/0072334 A1 Mar. 16, 2017

Related U.S. Application Data

(60) Provisional application No. 62/216,484, filed on Sep. 10, 2015.

(51) Int. Cl.
*A63H 37/00* (2006.01)

(52) U.S. Cl.
CPC ..... *A63H 37/00* (2013.01)

(58) Field of Classification Search
CPC ..... A63H 37/00
USPC ..... 221/278, 258
See application file for complete search history.

(56) References Cited

U.S. PATENT DOCUMENTS

| | | | | |
|---|---|---|---|---|
| 1,099,921 | A | 6/1914 | Gibson | |
| 1,122,421 | A | 12/1914 | Redington & Pell | |
| 3,731,421 | A * | 5/1973 | Frattolillo | A63H 37/00 446/178 |
| 4,257,745 | A | 3/1981 | Thur et al. | |
| 5,015,211 | A * | 5/1991 | Reveen | A63H 37/00 124/74 |
| 5,713,719 | A | 2/1998 | Fiore et al. | |
| 6,149,495 | A | 11/2000 | Austin et al. | |
| 6,260,989 | B1 * | 7/2001 | Ingraselino | A63H 37/00 362/249.06 |

(Continued)

FOREIGN PATENT DOCUMENTS

| | | | |
|---|---|---|---|
| GB | 2503244 | A | 12/2013 |
| WO | 2011141583 | A1 | 11/2011 |

*Primary Examiner* — Michael Collins

(74) *Attorney, Agent, or Firm* — John S. Artz; Dickinson Wright PLLC

(57) ABSTRACT

A dispensing apparatus for dispensing confetti. The dispensing apparatus includes a housing that has a base and a hood and defines a chamber. A barrier divides the chamber into a fan compartment and a storage compartment. A fan assembly is disposed in the fan compartment and includes a shroud and an exhaust conduit that extends from the shroud out of the hood of the housing. The fan assembly further includes an impeller that is disposed in the shroud to blow confetti through the exhaust conduit and to draw confetti into the shroud from the storage compartment. The apparatus further includes a conduit for conveying confetti toward the shroud. The conduit is disposed in the fan compartment and extends between the barrier and the shroud for allowing the confetti in the storage compartment to be uniformly transmitted into the shroud prior to being blown out of the exhaust conduit.

20 Claims, 2 Drawing Sheets

(56) References Cited

U.S. PATENT DOCUMENTS

| | | | | |
|---|---|---|---|---|
| 6,279,254 | B1 * | 8/2001 | Gill | G09F 19/00 40/412 |
| 6,641,458 | B1 | 11/2003 | Nofsinger et al. | |
| 6,804,905 | B1 * | 10/2004 | Burger, III | G09F 15/0025 40/212 |
| 8,876,574 | B2 | 11/2014 | Bourdelaise et al. | |
| 8,936,503 | B2 * | 1/2015 | Catanzaro | 446/242 |
| 9,839,861 | B1 * | 12/2017 | Ritz | A63H 37/00 |
| 2006/0046613 | A1 | 3/2006 | Mann | |
| 2006/0199469 | A1 * | 9/2006 | Du | A63H 37/00 446/475 |
| 2013/0150157 | A1 | 6/2013 | Losser | |
| 2013/0183884 | A1 * | 7/2013 | Catanzaro | A63H 33/26 446/485 |
| 2014/0217111 | A1 | 8/2014 | Sampson et al. | |

* cited by examiner

DISPENSING APPARATUS FOR DISPENSING CONFETTI IN RESPONSE TO AN OCCURRENCE OF AN EVENT ON A GAMING MACHINE

CROSS-REFERENCE TO RELATED APPLICATIONS

This application claims the benefit of U.S. Provisional Patent Application Ser. No. 62/216,484, filed on Sep. 10, 2015 and titled "A DISPENSING APPARATUS FOR DISPENSING CONFETTI IN RESPONSE TO AN OCCURRENCE OF AN EVENT ON A GAMING MACHINE", the entire disclosure of which is hereby incorporated by reference.

TECHNICAL FIELD

The present disclosure is directed toward a dispensing apparatus for dispensing confetti. More particularly, the present disclosure is directed toward a dispensing apparatus for dispensing confetti in response to an occurrence of an event on a gaming machine.

BACKGROUND OF THE DISCLOSURE

Dispensing apparatuses are known in the art for dispensing confetti in response to an occurrence of an event on a gaming machine, such as a slot machine, to provide increased excitement to patrons of a gaming environment like a casino. An example of such a dispensing apparatus is disclosed in International Patent Application Publication No. WO 2011/141583 to Alejandro de Viveiros Ortiz. The dispensing apparatus includes a housing that has a base and a hood that together define a chamber. A barrier is disposed in the housing and divides the chamber into a fan compartment and a storage compartment. A fan assembly is disposed in the fan compartment. The fan assembly includes a shroud and an exhaust conduit that extends from the shroud out of the hood of the housing. The fan assembly further includes an impeller that is disposed in the shroud to blow confetti through the exhaust conduit out of the housing and to draw confetti into the shroud from the storage compartment. A conduit is disposed in the chamber for conveying confetti toward the shroud.

There remains room for improvements to such dispensing apparatuses to provide increased excitement to patrons and to make the dispensing apparatus easier to assemble and disassemble such that it is easier to perform maintenance tasks on.

SUMMARY OF THE DISCLOSURE

According to an aspect of the disclosure, an improved dispensing apparatus is provided that is configured to hold a substantial amount of confetti in a storage compartment. More specifically, a conduit is exclusively provided in a fan compartment and thus does not take up storage space in the storage compartment. The increased storage space in the storage compartment provides for increased excitement to patrons of a gaming environment because they may be showered with a large amount of confetti after the occurrence of an event on a gaming machine.

According to another aspect of the disclosure, a dispensing apparatus is provided that uniformly distributes confetti out of the storage compartment and into the fan assembly. More specifically, a conduit extends between the storage compartment and shroud in alignment with an inlet of the shroud, thus allowing confetti to easily flow from the storage compartment to the shroud.

According to yet another aspect of the disclosure, a dispensing apparatus is provided that consists of few components and the components are generally modularly constructed. Therefore, the dispensing apparatus is easily and inexpensively manufactured, assembled, and disassembled and/or opened to allow maintenance tasks to be performed thereon.

In accordance with these and other aspects of the present disclosure, a dispensing apparatus for dispensing confetti in response to an occurrence of an event on a gaming machine is provided. The dispensing apparatus includes a housing that has a base and a hood and defines a chamber. A barrier is disposed in the housing and divides the chamber into a fan compartment and a storage compartment. A fan assembly is disposed in the fan compartment and includes a shroud and an exhaust conduit that extends from the shroud out of the hood of the housing. The fan assembly further includes an impeller that is disposed in the shroud to blow confetti through the exhaust conduit out of the housing and to draw confetti into the shroud from the storage compartment. The apparatus further includes a conduit for conveying confetti toward the shroud. The conduit is disposed in the fan compartment and extends between the barrier and the shroud for allowing the confetti in the storage compartment to be uniformly transmitted into the shroud prior to being blown out of the exhaust conduit.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE EXAMPLE EMBODIMENTS

Figure 1:
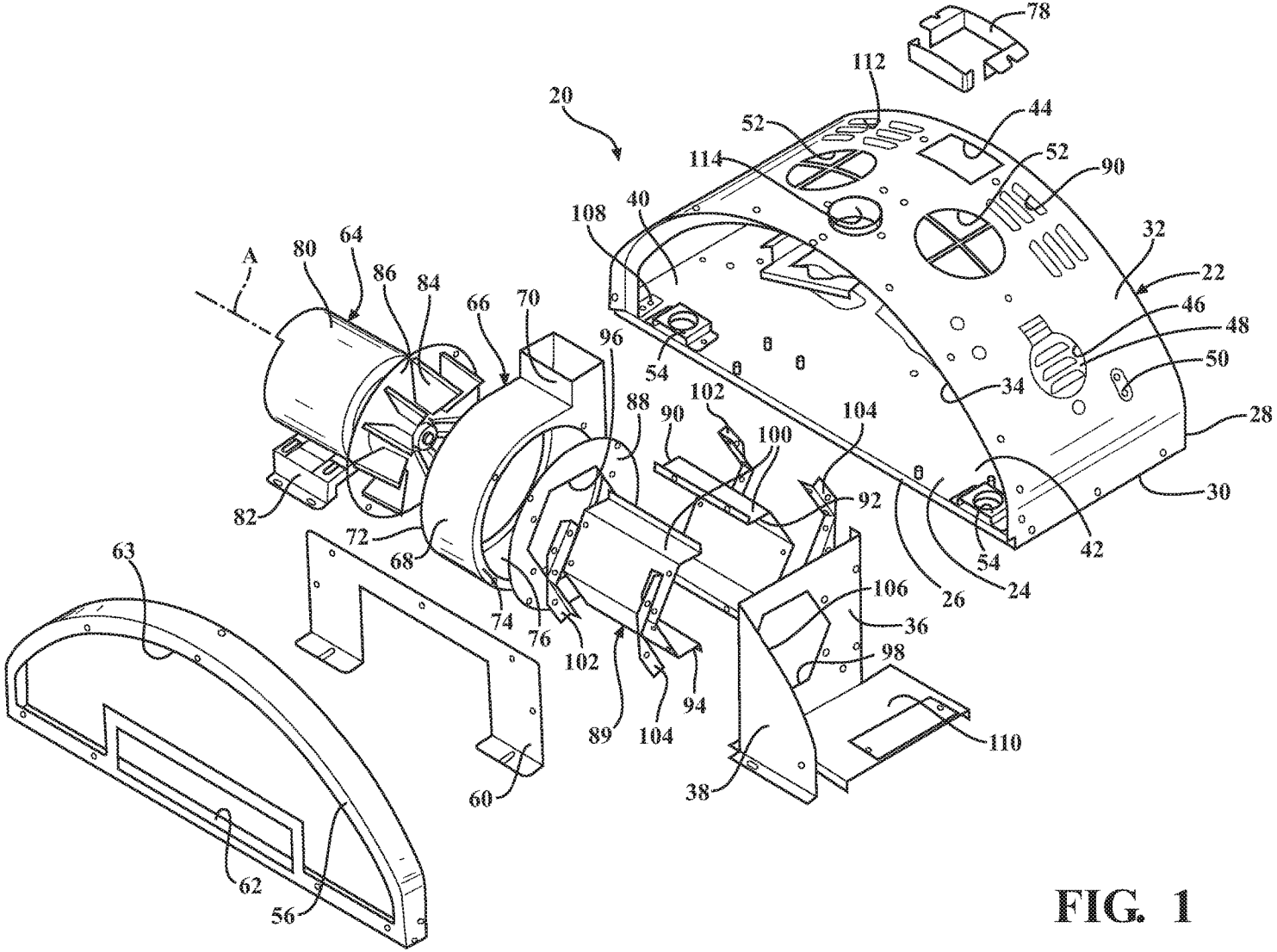
FIG. 1 is an exploded view of a dispensing apparatus according to an aspect of the disclosure.
Figure 2:
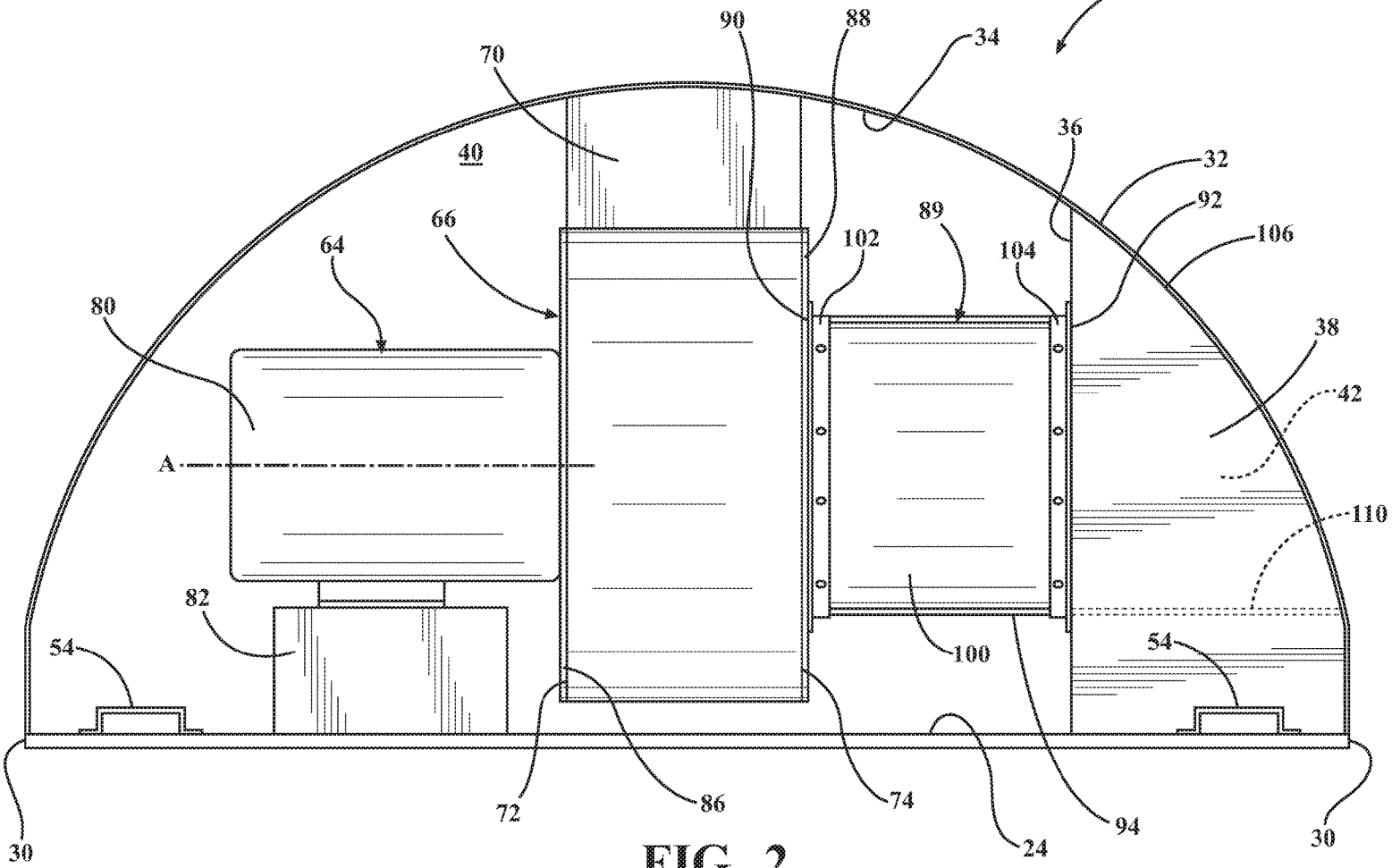
FIG. 2 is a side, cutaway view of a dispensing apparatus according to an aspect of the disclosure illustrating an assembled configuration of a fan assembly, conduit and storage compartment.

Referring to the Figures, wherein like numerals indicate corresponding parts throughout the several views, a dispensing apparatus 20 is generally shown for dispensing confetti in response to an occurrence of an event on a gaming machine. It should be appreciated that the term "gaming machine" as used herein may encompass various types of gaming machines, including but not limited to, slot machines, video poker machines and arcade games.

The dispensing apparatus 20 includes a housing 22. The housing 22 has a base 24 that may have a rectangular-shaped cross-section with a front edge 26, rear edge 28 and a pair of side edges 30. Further, the base 24 may substantially extend along a plane. It should be appreciated that the base 24 could have other shapes including, but not limited to, a square shape and an oval shape, and the base 24 could also be non-planar.

The housing 22 further includes a hood 32 that extends between the side edges 30 of the base 24 to define a chamber 34 between the base 24 and the hood 32. As shown, the hood 32 may have a semi-circular shaped cross-section, however, it should be appreciated that it could have other shapes including, but not limited to, a rectangular-shape. A barrier 36, 38 extends upwardly from the base 24 to the hood 32 to divide the chamber 34 into a fan compartment 40 and a storage compartment 42.

The hood 32 further defines a distribution slot 44 that extends into the fan compartment 40 and a confetti aperture 46 that extends into the storage compartment 42. A cap 48 is at least partially disposed in the confetti aperture 46 and is moveable between an open position and a closed position. When the cap 48 is in the open position, confetti may be poured into the storage compartment 42 through the confetti aperture 46. Further, when the cap 48 is in the closed position, the cap 48 seals the confetti aperture 46 such that confetti may be sealed in the storage compartment 42. A locking mechanism 50 may be operably connected to the cap 48 for locking and unlocking the cap 48. It should be appreciated that various types of locking mechanisms 50 could be utilized, e.g., a key and latch system. It should be appreciated that the locking mechanism 50 prevents patrons from tampering with or removing confetti in the storage compartment 42.

The hood 32 may further define a pair of upper speaker holes 52 that extend into the fan compartment 40. A pair of upper speakers may be connected to the hood 32 adjacent to the speaker holes for playing audio to users of the gaming machine. Additionally, a plurality of bottom speaker mounts 54 may be connected to the base 24 for supporting a plurality of lower speakers for playing audio to users of the gaming machine. It should be appreciated that speakers could alternatively be disposed at other locations in the chamber 34. It should further be appreciated that the speakers may be activated in response to the occurrence of an event on the gaming machine, and may be activated in conjunction with the dispersal of confetti from the dispensing apparatus 20.

The housing 22 further includes a front cover 56 that connects to the base 24 and the hood 32 at the front edge 26 of the base 24. The housing 22 also includes a rear cover (not shown) that is connected to the base 24 and the hood 32 at the rear edge 28 of the base 24. As shown, the front and rear covers 56 may have a semi-circular shape. It should be appreciated, however, that the front and rear covers 56, 58 could have other shapes, but the shape should correspond with the cross-sectional shape of the hood 32 and base 24.

A generally U-shaped light board 60 may be connected to and extend upwardly from the base 24 adjacent to the front edge 26 of the base 24 for holding a plurality of light emitting diodes. The front cover 56 may define a lower opening 62 adjacent to the light board 60 for allowing light from the light emitting diodes to emitted therethrough, and an upper opening 63 spaced from the lower opening 62 for allowing graphics to be presented thereon. The graphics may be presented on a translucent film or board. It should be appreciated that other light sources could be utilized and the light sources could be arranged in various shapes or patterns. It should further be appreciated that the lower and upper openings 62, 63 could have other shapes and sizes.

A fan assembly 64 is disposed in the fan compartment 40 for dispensing confetti through the distribution slot 44. The fan assembly 64 includes a shroud 66 that has a generally tube-shaped body portion 68 and an exhaust duct 70 that extends tangentially from the body portion 68 into the distribution slot 44. The body portion 68 of the shroud 66 extends along an axis A between a first side 72 and a second side 74 and defines a cavity 76 along the axis A. A chute bracket 78 may be received by the distribution slot 44 to interconnect the hood 32 and the exhaust conduit 70 and to sealingly align the exhaust conduit 70 within the distribution slot 44.

The fan assembly 64 further includes a motor 80 that is disposed along the axis A in the fan compartment 40 adjacent to the shroud 66. A lower bracket 82 may interconnect the motor 80 and the base 24. The fan assembly 64 further includes an impeller 84 that is disposed in the cavity 76 of the fan shroud 66 and rotatably coupled to the motor 80 along the axis A for rotating about the axis A in response to driving of the motor 80 to blow confetti out of the exhaust conduit 70 and to draw confetti into the shroud 66 from the storage compartment 42.

The shroud 66 further includes an adapter plate 86 that has a circular-shaped cross-section disposed about the axis A and interconnects the motor 80 and the first side 72 of the shroud 66 to close the first side 72 of the shroud 66. The shroud 66 also includes a connection member 88 that has a circular-shaped cross-section and is disposed about the axis A and is connected to the second side 74 of the shroud 66 to close the front side of the shroud 66. It should be appreciated that the shroud 66, adapter plate 86, and connection member 88 could have other cross-sectional shapes, e.g., a square-shape.

A conduit 89 is disposed in the fan compartment 40 and extends between the barrier 36, 38 and the shroud 66 for allowing confetti in the storage compartment 42 to be uniformly transmitted into the shroud 66 through a passageway defined by the conduit 70 prior to being blown out of the exhaust duct 70. The conduit 89 extends along the axis A between a frontward side 90 that engages the connection member 88 and a rearward side 92 that engages the adapter plate 86 and has a bottom portion 94. The passageway is spaced from the base 24. It should be appreciated that disposing the conduit 89 exclusively in the fan compartment 40 does not use up storage space in the storage compartment 42. The increased space in the storage compartment 42 may provide increased excitement of the gaming environment since more confetti may be dispensed after the occurrence of an event on the gaming machine while still providing a compact overall design of the dispensing apparatus 20. Additionally, disposing the conduit 89 exclusively in the fan compartment 42 prevents the out walls of the conduit 89 from interfering with the transmittal of confetti into the opening of the conduit 89.

The connection member 88 defines an inlet 96 that has a hexagonal shape along the axis A for receiving confetti into the conduit 89 from the storage compartment 42. Likewise, the barrier 36, 38 defines a passage 98 that has a hexagonal shape to receive confetti from the conduit 89 into the shroud 66. Further, the passage 98 of the conduit 89 has a hexagonal shaped cross-section to align the conduit 89 with the inlet 96 and passageway. The inlet 96, passage 98 and passageway all also have substantially the same size. It should be appreciated that the common hexagonal shape and size of the inlet 96, passage 98, and passageway of the conduit 89 help provide uniform distribution of confetti passing from the storage compartment 42 to the fan assembly 64 since confetti does not get trapped on edges of the connection member 88 or barrier 36, 38 during passing of confetti from the storage compartment 42 to the fan assembly 64.

The conduit 89 is divided into two segments 100 that are mirror images of one another along a plane being transverse to the axis A. It should be appreciated that the conduit 89 could alternatively be divided into more segments 100. It should also be appreciated that the modular construction of the conduit 89 allows the conduit 89 to be easily assembled and disassembled, allowing the passageway of the conduit 89 to easily be accessed during maintenance of the dispensing apparatus 20.

A pair of front brackets 102 each interconnect one of the segments 100 of the conduit 89 and the connection member 88. Likewise, a pair of rear brackets 104 each interconnect one of the segments 100 of the conduit 89 and the barrier 36, 38. The barrier 36, 38 has a generally L-shape and includes a first wall 36 that extends perpendicularly to the front and rear covers 56, 58, and a second wall 38 that extends parallel to the front and rear covers 56, 58. The second wall 38 has an upper edge 106 that is nested with the hood 32 of the housing 22 to seal the storage compartment 42 from the front cover 56 and the bottom speaker mount 54. As shown, the upper edge 106 may have an arc-shape to provide this nesting relationship. The rearward side 92 of the conduit 89 abuts the first wall 36 of the barrier 36, 38. Furthermore, the first wall 36 defines the passage 98.

The base 24 defines a plurality of connection orifices 108 for receiving a plurality of fasteners to connect the dispensing apparatus 20 to the top of the gaming machine. Furthermore, a shelf 110 is disposed in the storage compartment 42 and extends in spaced and parallel relationship to the base 24 to elevate the confetti disposed in the storage compartment 42 to allow the confetti to be fed into the conduit 89 and to space the confetti from the fasteners in the storage compartment 42. More specifically, the bottom portion 94 of the conduit 89 is aligned with the shelf 110 to prevent confetti from getting trapped in the storage compartment 42 against the first wall 36, thereby aiding in uniformly transmitting the confetti into the shroud 66.

The hood 32 may further defines a plurality of cooling slots 112 that extend into the fan compartment 40 for allowing heat generated by the motor 80 to escape the fan compartment 40. The hood 32 may also define a light orifice 114 into the fan compartment 40 for receiving a decorative light. It should be appreciated that decorative lights of various shapes, sizes and colors could be received by the light orifice 114.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims.

What is claimed is:

1. A dispensing apparatus for dispensing confetti in response to an occurrence of an event on a gaming machine, the dispensing apparatus comprising:

a housing having a base and a hood defining a chamber, wherein the base defines a plurality of connection orifices for receiving a plurality of fasteners to connect the dispensing apparatus to the top of the gaming machine;

a barrier disposed in the housing and dividing the chamber into a fan compartment and a storage compartment;

a fan assembly disposed in the fan compartment including a shroud and an exhaust duct extending tangentially from the shroud out of the hood of the housing:

the fan assembly further including an impeller disposed in the shroud to blow confetti through the exhaust duct out of the housing and to draw confetti into the shroud from the storage compartment;

a conduit for conveying confetti toward the shroud; and the conduit disposed in the fan compartment and extending between the barrier and the shroud for allowing the confetti in the storage compartment to be uniformly transmitted into the shroud prior to being blown out of the exhaust duct.

2. A dispensing apparatus as set forth in claim 1 further including a shelf disposed in the storage compartment and extending in spaced relationship with the base to elevate the confetti stored in the storage compartment to allow the confetti to be uniformly fed into the conduit and to space the confetti from the base to provide space for fasteners to extend through the base for securing the base to the gaming machine.

3. A dispensing apparatus as set forth in claim 2 wherein the conduit has a bottom portion and defines passageway being spaced from the base with the bottom portion aligned with the shelf.

4. A dispensing apparatus as set forth in claim 1 wherein the conduit is divided into at least two segment.

5. A dispensing apparatus as set forth in claim 4 wherein the conduit extends about and along an axis and the conduit is divided into two of the segments with the segments being mirror images of one another along a plane being transverse to the axis.

6. A dispensing apparatus as set forth in claim 1 wherein the shroud has a generally tube shape and extends about and along an axis between a front side and a back side and defines a cavity containing the impeller.

7. A dispensing apparatus as set forth in claim 6 further including a motor disposed along the axis in the fan compartment adjacent to the shroud and coupled with the impeller along the axis for providing rotational movement to the impeller.

8. A dispensing apparatus as set forth in claim 7 further including an adapter plate disposed about the axis and interconnecting the motor and the rear side of the shroud to close the rear side of the shroud.

9. A dispensing apparatus as set forth in claim 8 further including a connection member disposed about the axis and connected to the front side of the shroud to close the front side of the shroud.

10. A dispensing apparatus as set forth in claim 9 further including at least one front bracket interconnecting the conduit and the connection member.

11. A dispensing apparatus as set forth in claim 10 further including at least one rear bracket interconnecting the conduit and the barrier.

12. A dispensing apparatus as set forth in claim 11 where the connection member defines an inlet along the axis for receiving confetti into the shroud from the conduit.

13. A dispensing apparatus as set forth in claim 12 wherein the barrier defines a passage along the axis for receiving confetti from the storage compartment into the conduit.

14. A dispensing apparatus as set forth in claim 13 wherein the barrier has an L-shape and includes a first wall and a second wall extending in generally perpendicular relationship with one another, and the first wall defines the passage along the axis.

15. A dispensing apparatus as set forth in claim 14 wherein the second wall nests with the hood of the housing to seal the storage compartment.

16. A dispensing apparatus as set forth in claim 1 wherein the hood defines a confetti aperture extending into the storage compartment, a cap is moveably disposed in the confetti aperture and moveable between an open position and a closed position, and a locking mechanism is operably connected to the cap for locking and unlocking the cap.

17. A dispensing apparatus as set forth in claim 1 further including a plurality of bottom speaker mounts connected to the base for supporting a plurality of lower speakers for playing audio to users of the gaming machine.

18. A dispensing apparatus as set forth in claim 1 further including a light board connected to and extending upwardly from the base for holding a plurality of light emitting diode.

19. A dispensing apparatus for dispensing confetti in response to an occurrence of an event on a gaming machine, the dispensing apparatus comprising:

a housing having a base and a hood defining a chamber;

a barrier disposed in the housing and dividing the chamber into a fan compartment and a storage compartment;

a fan assembly disposed in the fan compartment including a shroud and an exhaust conduit extending from the shroud out of the hood of the housing:

the fan assembly further including an impeller disposed in the shroud to blow confetti through the exhaust conduit out of the housing and to draw confetti into the shroud from the storage compartment;

a conduit for conveying confetti toward the shroud;

the conduit disposed in the fan compartment and extending between the barrier and the shroud for allowing the confetti in the storage compartment to be uniformly transmitted into the shroud prior to being blown out of the exhaust conduit;

wherein the shroud has a generally tube shape and extends about and along an axis between a front side and a back side and defines a cavity containing the impeller;

further including a motor disposed along the axis in the fan compartment adjacent to the shroud and coupled with the impeller along the axis for providing rotational movement to the impeller;

further including an adapter plate disposed about the axis and interconnecting the motor and the rear side of the shroud to close the rear side of the shroud;

further including a connection member disposed about the axis and connected to the front side of the shroud to close the front side of the shroud;

further including at least one front bracket interconnecting the conduit and the connection member;

further including at least one rear bracket interconnecting the conduit and the barrier;

where the connection member defines an inlet along the axis for receiving confetti into the shroud from the conduit;

wherein the barrier defines a passage along the axis for receiving confetti from the storage compartment into the conduit; and wherein the passage of the barrier and the passageway of the conduit and the inlet of the connection member each have a hexagonal-shaped cross-section and are the same size as one another and are disposed in coaxial alignment with one another;

wherein the passage of the barrier and the passageway of the conduit and the inlet of the connection member each have a hexagonal-shaped cross-section and are the same size as one another and are disposed in coaxial alignment with one another.

20. A dispensing apparatus for dispensing confetti in response to an occurrence of an event on a gaming machine, the dispensing apparatus comprising:

a housing having a base and a hood defining a chamber, wherein the base defines a plurality of connection orifices for receiving a plurality of fasteners to connect the dispensing apparatus to the top of the gaming machine and a plurality of lower speaker mounts for supporting a plurality of lower speakers for playing audio to the users of the gaming machine and wherein the hood defines a plurality of upper speaker holes for transmitting the audio through the housing to the users of the gaming machine;

a barrier disposed in the housing and dividing the chamber into a fan compartment and a storage compartment;

a fan assembly disposed in the fan compartment including a shroud and an exhaust duct extending tangentially from the shroud out of the hood of the housing:

the fan assembly further including an impeller disposed in the shroud to blow confetti through the exhaust duct out of the housing and to draw confetti into the shroud from the storage compartment;

a conduit for conveying confetti toward the shroud; and the conduit disposed in the fan compartment and extending between the barrier and the shroud for allowing the confetti in the storage compartment to be uniformly transmitted into the shroud prior to being blown out of the exhaust duct.

* * * * *